US005230576A

United States Patent [19]

Sone

[11] Patent Number: 5,230,576

[45] Date of Patent: * Jul. 27, 1993

[54] PRINTER

[75] Inventor: Masakazu Sone, Tokyo, Japan

[73] Assignee: Sony Corporation, Tokyo, Japan

[ * ] Notice: The portion of the term of this patent subsequent to Nov. 27, 2008 has been disclaimed.

[21] Appl. No.: 442,857

[22] Filed: Nov. 29, 1989

[30] Foreign Application Priority Data

Nov. 30, 1988 [JP] Japan ..... 63-303272
Nov. 30, 1988 [JP] Japan ..... 63-303273

[51] Int. Cl.[5] ..... B41J 11/02

[52] U.S. Cl. ..... 400/649; 400/120; 400/613; 400/692

[58] Field of Search ..... 400/691, 692, 693, 693.1, 400/694, 120, 649, 613; 346/136, 145

[56] References Cited

U.S. PATENT DOCUMENTS 3,216,021 11/1965 Stefansson ..... 346/136
3,294,212 12/1966 Gearheart et al. ..... 400/613
3,778,842 12/1973 Saito ..... 346/136
4,632,585 12/1986 Oyamatsu et al. ..... 400/613
4,641,980 2/1987 Matsumoto et al. ..... 400/120
4,848,945 7/1989 Sone ..... 400/649

FOREIGN PATENT DOCUMENTS 2552541 3/1985 France .
61-144469 6/1986 Japan .

*Primary Examiner*—Egar S. Burr
*Assistant Examiner*—C. A. Bennett
*Attorney, Agent, or Firm*—Hill, Van Santen, Steadman & Simpson

[57] ABSTRACT

A printer is provided which has an openable front panel. This front panel is opened to load printing paper into a paper tray which is invisibly located behind the front panel. The paper tray is provided in a mechanical sub-chassis movably disposed within a mechanical main chassis of the printer. The sub-chassis is laterally slidable relative to the main chassis via a pair of guide rails and is rotatable to open the front panel via a pair of arm plate to expose the paper tray outside of the printer body. The arm plates are attached to a drive shaft supported by the main chassis so as to allow slight relative displacement therebetween to cancel assembly error. According to rotation of the drive shaft, the both arm plates swing synchronously.

9 Claims, 11 Drawing Sheets

PRINTER

BACKGROUND OF THE INVENTION

1. Technical Field

The present invention relates generally to a printer which prints an image on printing paper via a printing head. More particularly, the invention relates to a thermal printer which provides for easy replacement of rolls of printing paper.

2. Background Art

Japanese Patent First Publication (tokkaisho) No. 63-1571, corresponding to U.S. Pat. No. 4,848,945, commonly owned with this application discloses a thermal printer in which a thermal head prints an image on thermosensitive paper drawn from a roll thereof. This printer includes a paper housing provided within a sub-chassis for storing the roll of paper. This sub-chassis is laterally slidable outward from the printer main chassis so as to expose the paper housing for easy loading of the roll of paper into it. This sliding movement is performed by a sliding system which operates in cooperation with ahead shifter for shifting up and down the thermal head against a platen roller rotatably supported by the main chassis. Withdrawing the sub-chassis causes the head shifter to separate the thermal head from the platen roller, while pushing back the sub-chassis into the printer causes the thermal head to be urged against the platen roller with the printing paper therebetween.

Such a conventional printer employs a so-called linear skating system wherein the sub-chassis moves parallel to the main chassis. This linear skating system essentially requires a sliding mechanism, such as long sliding rails, to expose the paper housing provided within the sub-chassis. The sliding rails consequently increase the size of the printer.

The coordinated movement of a head shifting system with the withdrawing movement tends to complicate the linkage between the sliding mechanism and the head shifter. There are therefore problems in assembly and reliability, as well as increased production costs.

Additionally, once a roll of paper is loaded into the paper housing of the sub-chassis, the thermal head is kept pressed to the platen roller, causing undesired pressure on the platen roller.

Further, in the conventional printer, a shaft or similar mechanism provides support for the platen roller, such that movement thereof relative to the sub-chassis is achieved, and positioning errors between the platen roller and the thermal head and prevented. Due to variations in the assembly accuracy of the platen roller relative to the sub-chassis, accurate positioning between the platen roller and the thermal head is difficult.

SUMMARY OF THE INVENTION

It is accordingly one object of the present invention to provide a thin, compact printer which offers easy loading/unloading of printing paper.

It is another object of the invention to provide a printer which includes a simple system for positioning a printing head relative a platen roller precisely and easily.

According to one aspect of the present invention, there is provided a printing apparatus which comprises a main chassis having a printing head positioned at an upper portion thereof, a sub chassis having a platen roller rotatably attached and having a printing medium storage means positioned below the platen, the sub chassis being positioned inside of the main chassis, a sliding means slidably holding the sub chassis for allowing the sub chassis to be drawn in a horizontal direction outward of the main chassis through an aperture therein, a rotating means for opening a storage tray for the printing medium storage means drawn by the sliding means dependent on pivoting on a point provided therefor on the sub chassis and the sliding means.

In the preferred mode, the sliding means is provided on both sides of the main chassis and sub chassis thereof. The rotating means comprises a pair of arms attached to both sides of the main chassis and sub chassis. Driving pins may be provided each of which is attached to a pivot of each of said arms and is positioned between positioning means formed on the arms so as to allow a clearance between the pin and the positioning means to compensate for assembly error in one or both of the pins and/or the arms.

According to another aspect of the invention, there is provided a printer which comprises a casing, a first mechanical chassis disposed within the casing, on which a printing head for printing on a printing medium is mounted, a second mechanical chassis disposed within the first mechanical chassis, on which a platen roller is rotatably mounted, a housing provided within the second mechanical chassis for storing the printing medium, a first means for linearly shifting the second mechanical chassis relative to the first mechanical chassis, and a second means for rotating the second mechanical chassis to expose the housing outside the printer in cooperation with the first means.

In the preferred mode, the first means includes a guide plate which is connected to the second mechanical chassis so as to allow it to pivot with respect to a connecting point. The guide plate is slidingly held by the first mechanical chassis so as to allow the second mechanical chassis to travel outside the printer.

The second means includes a pair of arm plates, a shaft, and a drive unit for rotating the shaft. The shaft is supported by the first mechanical chassis and supporting one end of each of the arm plates through connecting means. Other ends of the arm plates is rotatably attached to the second mechanical chassis. The connecting means is operable to swing the arm plates synchronously with each other according to rotation of the shaft.

The connecting means includes a pair of pins and pairs of protrusions which are formed on the arm plates respectively so as to be spaced from each other by a given gap. The pins are inserted into end portions of the shaft and each is located between the protrusions so as to engage one of the protrusions according to the rotation of the shaft to swing the arm plates synchronously with each other.

BRIEF DESCRIPTION OF THE DRAWINGS

The present invention will be understood from the detailed description given hereinbelow and from the accompanying drawings of the preferred embodiment of the invention which are not intended to limit the invention to the specific embodiment but are for explanation and understanding only.

DESCRIPTION OF THE PREFERRED EMBODIMENT

Figure 1:
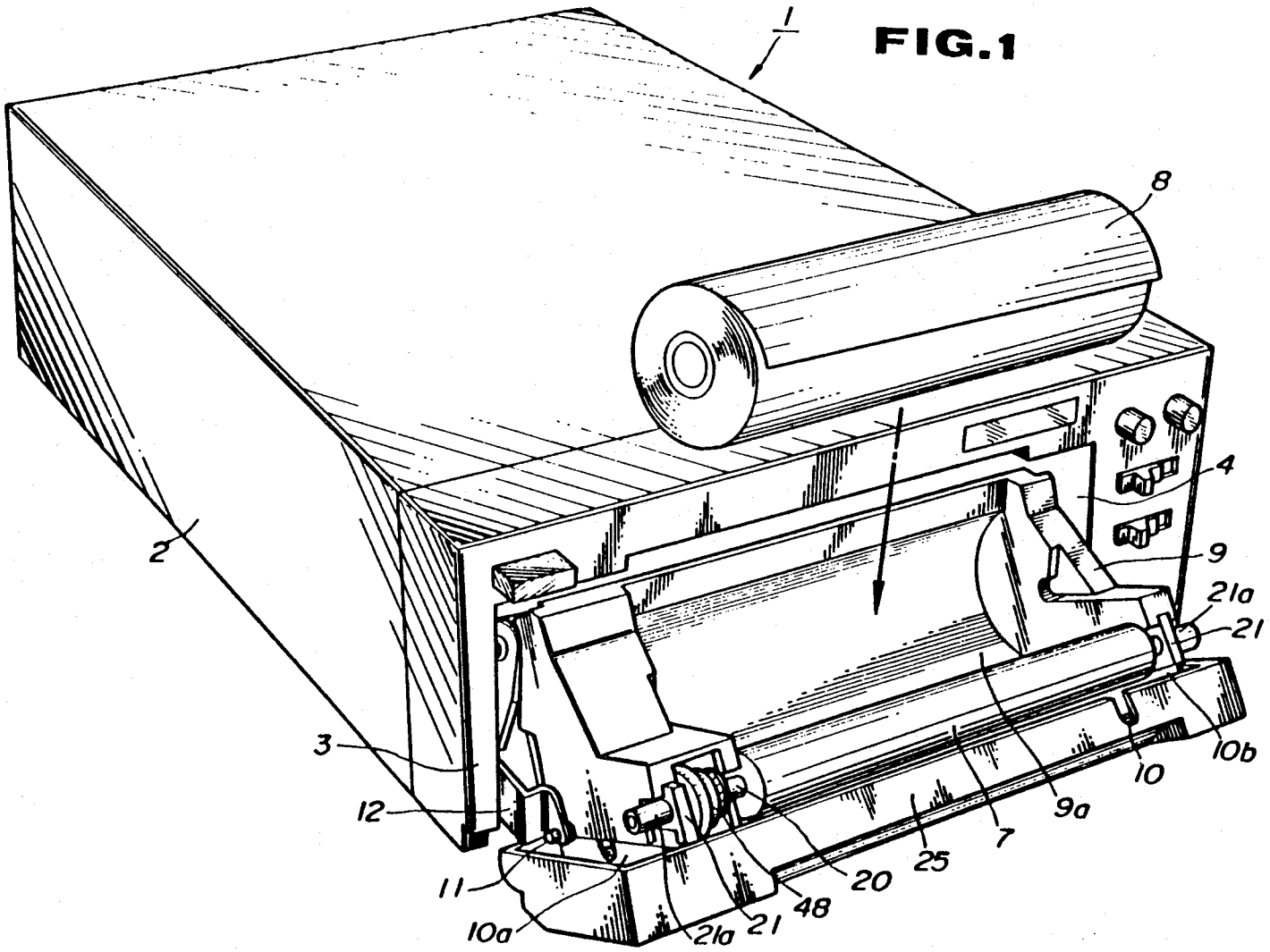
FIG. 1 is a perspective view which shows a printer according to the present invention.

Referring now to the drawings, particularly to FIG. 1, a thermal printer 1 according to the present invention is shown. This printer 1 is adapted for printing an image on thermosensitive paper withdrawn from a roll of printing paper stored in a paper tray 9 to a printing station. When the printing paper is used up, a paper sensor (not shown) senses the absence of a sheet of paper and indicates such to an operator. The operator can open a front panel 25 of the printer to load a new roll of paper into the paper tray 9.

Figure 2:
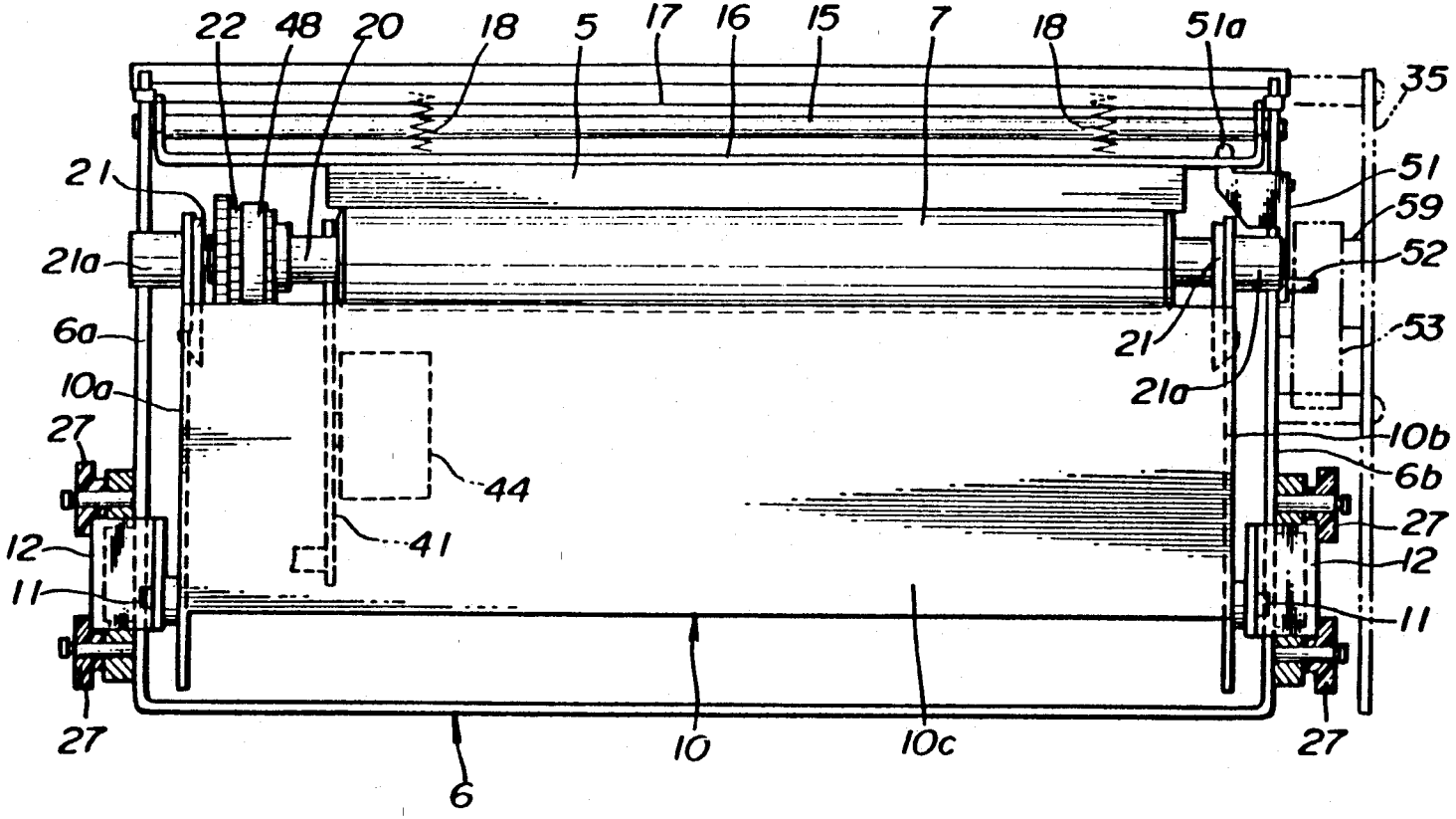
FIG. 2 is a cross-sectional front view of the printer of FIG. 1.

The printer 1 includes a printer cabinet 2 in which a rectangular opening 4 is formed at the front 3 thereof. A mechanical main chassis 6 on which a thermal head (printing head) 5 is placed, is, as shown in FIG. 2, disposed within the cabinet and a mechanical sub-chassis 10 is mounted inside, contacting both side walls 6*a* and 6*b* of the main chassis. A platen roller 7 is rotatably supported in the sub-chassis 10. The printing medium storage means is provided in the form of a paper tray 9 for storing a roll of thermosensitive paper 8 is installed. The paper tray 9 has an opening 9*a* for loading/unloading the roll of printing paper 8.

Figure 4:
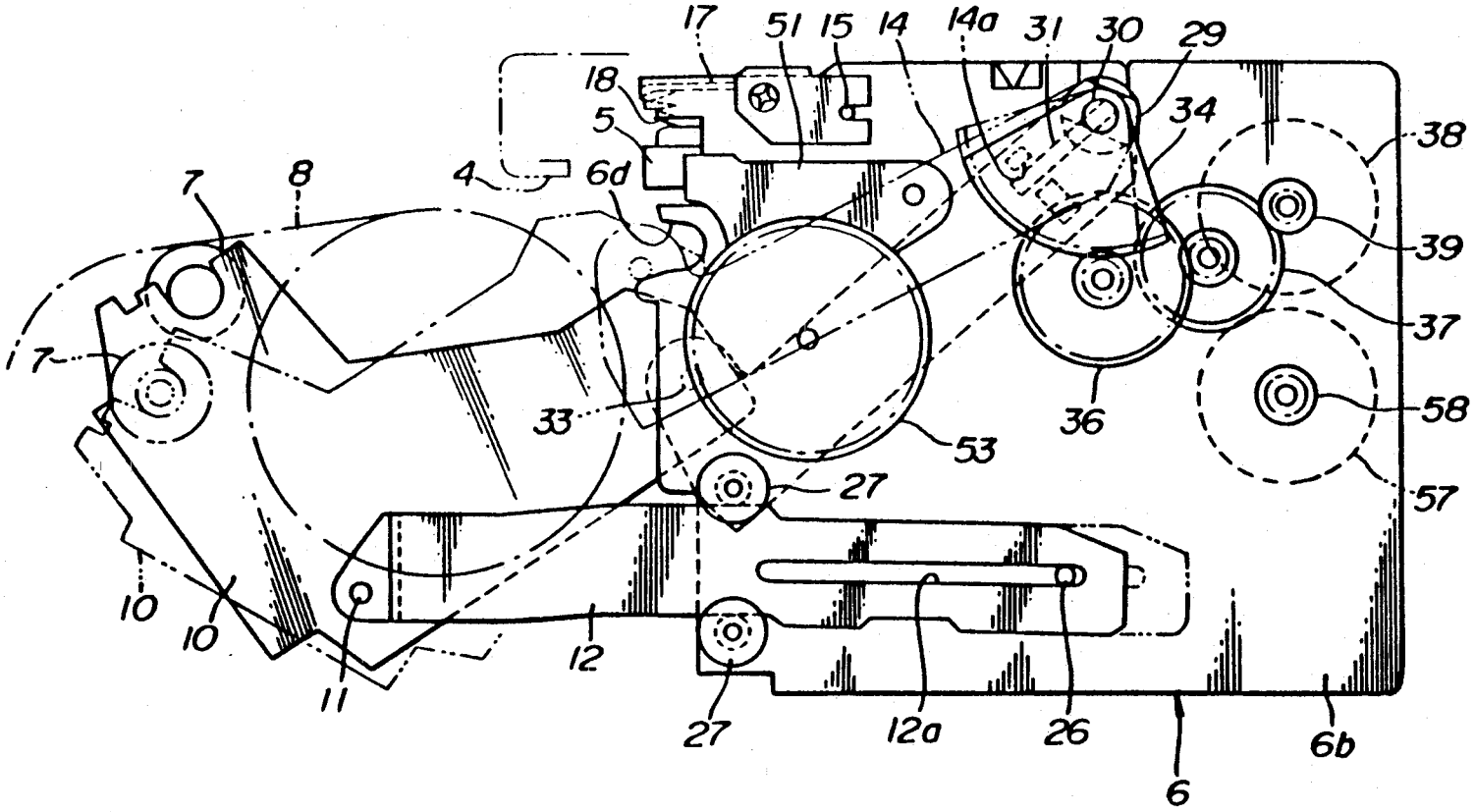
FIG. 4 is a cross-sectional view of the right side of a printer with an open front panel which shows a front panel sliding mechanism according to the invention.
Figure 5:
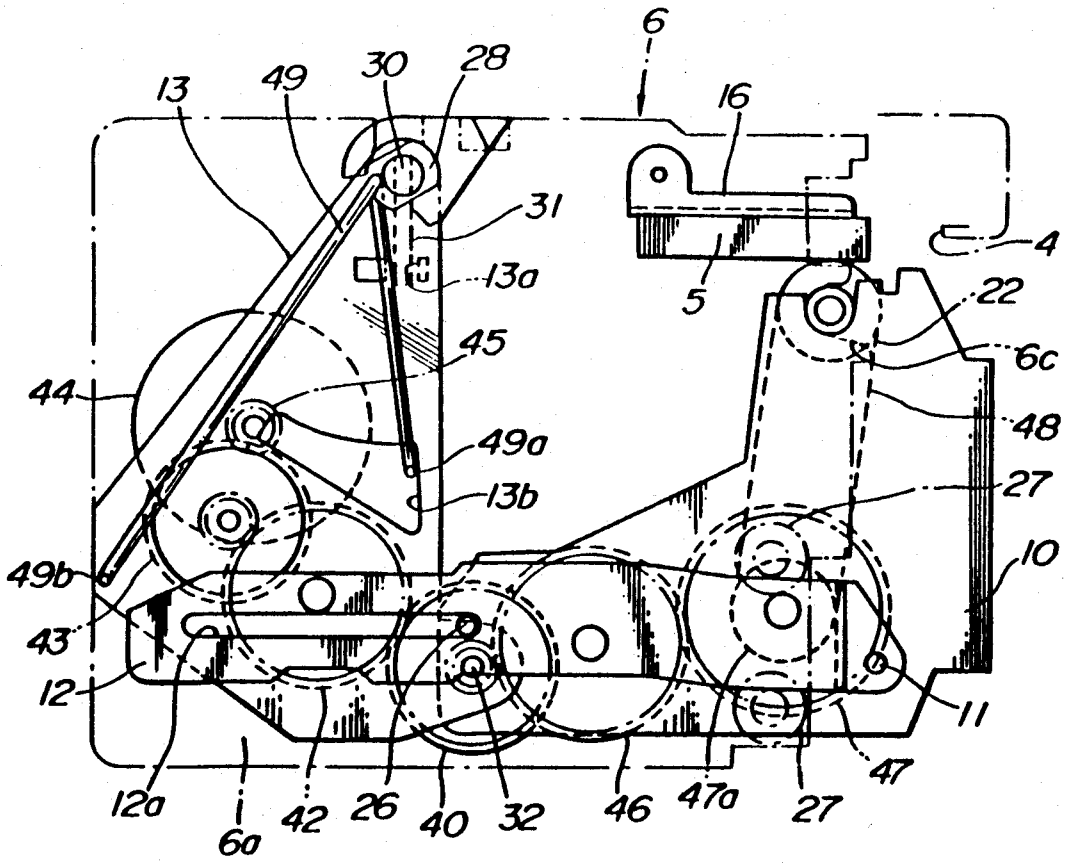
FIG. 5 is a cross-sectional view of the left side of a printer with a front panel being closed, which shows a head shifting mechanism and a front panel sliding mechanism according to the invention.

A pair of guide rails 12 are mounted in the lower portions of the side walls 10*a* and 10*b* of the sub-chasis 10 via pins 11 for sliding movement relative to the main chassis 6 from the opening 4 outward. A pair of arm plates 13 and 14 are, as shown in FIG. 4, rotatably mounted on the main chassis 6 for horizontally ejecting the sub-chassis 10 outward with rotation of the sub-chassis about the pin 11.

The thermal head 5, as shown in FIGS. 2 to 5, is attached to the bottom of a substantially U-shaped support frame 16, which is disposed between side walls 6*a* and 6*b* for rotational movement relative thereto. A pair of coil springs 18 are disposed between the support frame 16 and an upper plate 17, secured to the side walls 6*a* and 6*b* with screws, for urging the thermal head 5 against the outer peripheral surface of the platen roller 7, with the printing paper therebetween, during printing.

The platen roller 7 is secured on a shaft 20 which is rotatably supported by the side walls 10*a* and 10*b* of the sub-chassis 10 via a pair of bearings 21 made of synthetic resin.

A pulley 22 is installed on an end portion of the shaft 20 for rotating the platen roller 7. The bearings 21 include cylindrical portions 21*a* respectively which are received in U-shaped cut away portions 6*a* and 6*b* to position the platen roller relative to the thermal head when the front panel is closed to start printing.

The paper tray is made of a synthetic resin and is mounted within the sub-chassis 10. The platen roller 7 is located at the front side of the opening 9*a* of the paper tray. The front panel 25 is attached to the front portion 10*c* of the sub-chassis 10 for closing the opening 4.

Guide Rail

Figure 3:
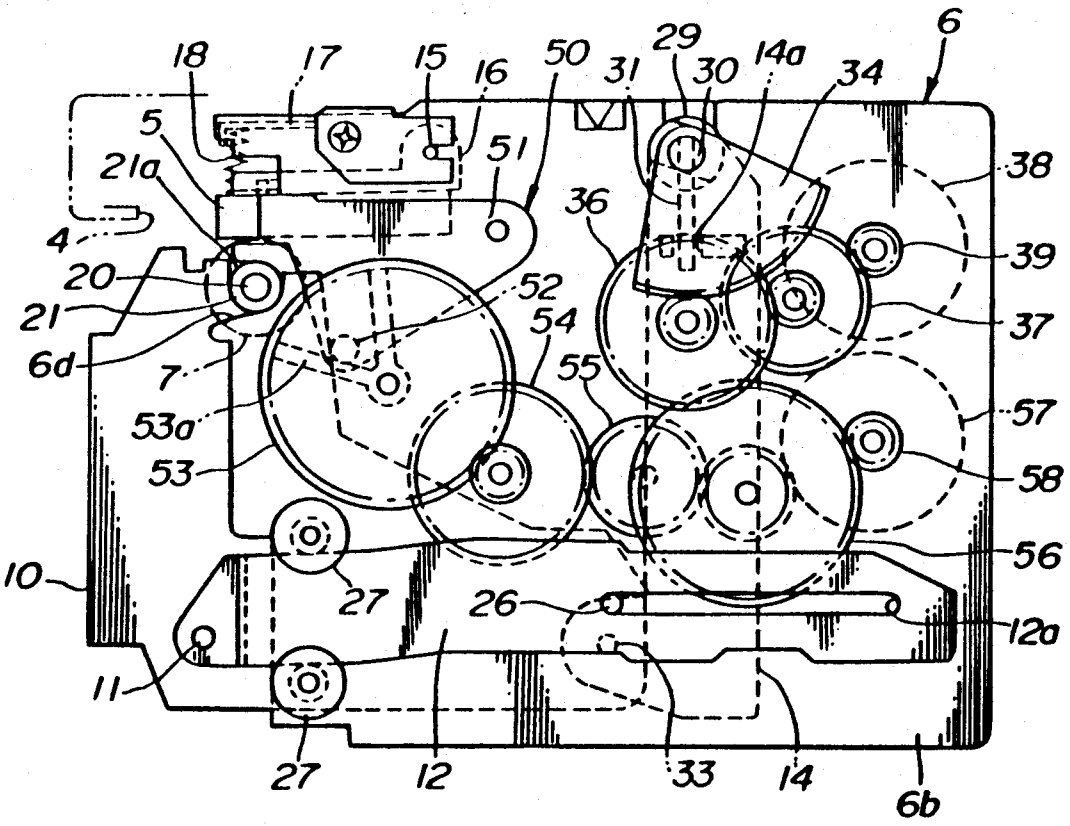
FIG. 3 is a cross-sectional view of the right side of a printer with a front panel being closed, which shows a head shifting mechanism and a front panel sliding mechanism according to the invention.

The pair of guide rails 12 are, as mentioned previously, mounted on the sub-chassis for sliding the sub-chassis relative the main chassis. As shown in FIG. 3, an elongated opening 12*a* is formed in each guide rail. Pins 26 projected from the side walls 6*a* and 6*b* of the main chassis 6 are respectively inserted into the openings 12*a* to allow lateral displacement of the sub-chassis within the range defined by the opening. A pairs of rollers 27 are rotatably mounted on the front portions of the side walls 6*a* and 6*b* with pins to allow sliding movement of the guide rails therebetween.

Each arm plate 13 and 14 is made of synthetic resin and are supported by a drive shaft 30 with a certain amount of play therebetween. This drive shaft is rotatably disposed between the upper portions of the side walls 6*a* and 6*b* of the main chassis 6 via bearings 28 and 29 also made of synthetic resin. The arm plates 13 and 14 are located inside the side walls 6*a* and 6*b* of the main chassis 6 and each has a pair of projecting portions 13*a* and 14*a* on its inner surface which, in combination, form the positioning means. Drive pins 31 are perpendicularly inserted into portions provided at each end of the drive shaft 30 respectively by press-fitting and engage the arm plates so as to allow slight movement between the pair of projecting portions 13*a* and 14*a*. By providing this play between the drive pins and the arm plate, assembly error can be eliminated. Swinging of the drive pins 31 causes the ends thereof to contact the projecting portions respectively to shift the arm plates up or down synchronously. The front end portions of the arm plates 13 and 14 are rotatably supported by the side walls 10*a* and 10*b* via a shaft 32 and a pin 33 respectively. Rotation of the arm plates 13 and 14 causes the sub-chassis 10 to rotate about the pins 11 of the guide rails 12.

A fan-shaped gear 34, of synthetic resin, is secured on the end portion projecting outward from the side wall 6*b* of the main chassis 6. This gear meshes with a pinion gear 39 of a panel motor 38 mounted on the side wall 6*b* through first and second gears 36 and 37 rotatably mounted between the side wall 6*b* and a mounting plate 35. Actuating the panel motor 38 causes the fan-shaped gear 34 to rotate, swinging the arm plates 13 and 14, thereby opening and closing the front panel 25 automatically.

An intermediate gear 40 is rotatably supported by the shaft 32 which supports the sub-chassis 10 and the arm plate 13. The intermediate gear 40 engages a pinion gear 45 of a drive motor 44 fixed on a metal side plate 41 through third and fourth gears 42 and 43 which are rotatably supported between the side plate 41 and the arm plate 13. The intermediate gear 40 includes a pinion gear. This pinion gear engages a drive gear 47 through a fifth gear 46 which is rotatably supported between the side wall 10*a* of the sub-chassis 10 and the paper tray 9. The drive gear 47 has a small pulley 47*a* which is connected to a pulley 22, via a timing belt, fixedly mounted on the shaft rotatably supporting the platen roller 7. It will be noted that activation of the drive motor 44 causes the platen roller to rotate via the gear train, including the intermediate gear 40.

A substantially triangular opening 13*b* is formed in the center portion of the arm plate 13. A substantially V-shaped elastic pin spring 49 is fixed by the bearing 28 of the drive shaft 30 at the folded portion of the pin spring 49. One end 49*a* of the pin spring 49 engages the opening 13*b* while the other end 49*b* thereof contacts with the base end portion of the left guide rail 12 according to the rotation of the arm plate 13 to urge the guide rail forward. In other words, the spring 49 provides elastic force for pushing the guide rails 12 outward only when the sub-chassis 10 has been drawn out from the main chassis to enhance the rotational retraction of the sub-chassis.

Head Shifting System

Figure 7:
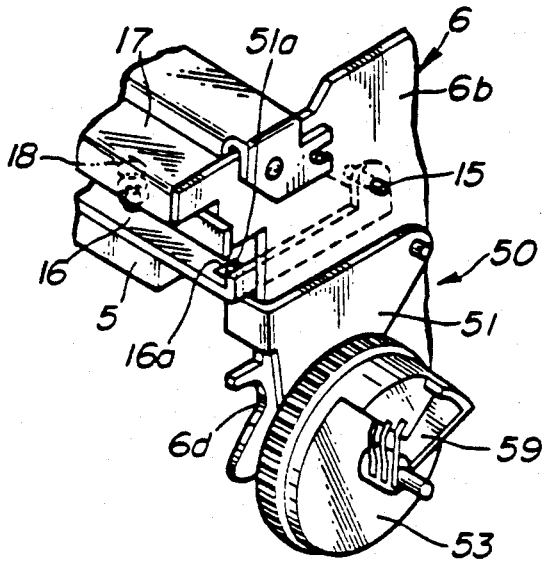
FIG. 7 is a perspective view which shows a head shifter for shifting a printing head up and down against a platen roller.
Figure 8:
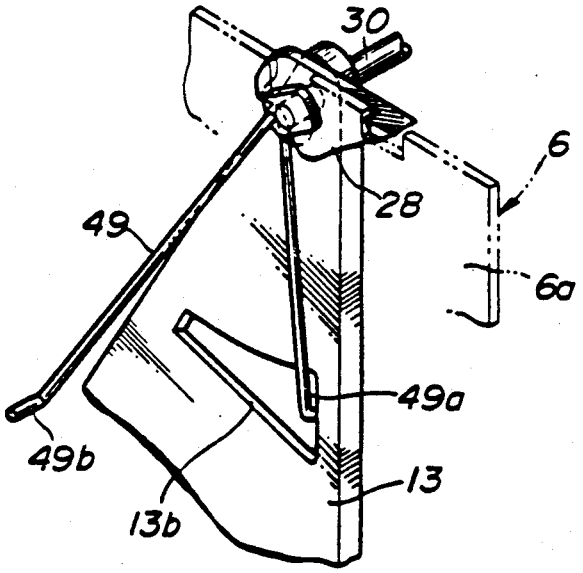
FIG. 8 is a perspective view which shows an arm plate of a front panel sliding mechanism.

Referring to FIG. 7, a head shifter 50 is shown which is located on the right wall 6*b* of the main chassis 6 The head shifter 50 is pivotably supported by the right wall 6*b* via a pin and includes a triangular driving plate 51. This driving plate has a projecting portion 51*a* which is inserted into an opening 16*a* of the supporting frame 16. As shown in FIGS. 2 and 3, a drive pin 52 projects perpendicularly from the lower portion of the driving plate 51. The drive pin 52 engages a V-shaped rib 53*a* formed on the inside surface of a control gear 53 which is rotatably supported between the right wall 6*b* of the main chassis 6 and the plate The control gear 53 meshes a pinion gear 58 of a shift motor 57 mounted on the right wall 6*b* through a sixth, a seventh, and an eighth gear, 54, 55, and 56 respectively. Thus, driving rotation of the shift motor 57, in, for example, the clockwise direction in FIG. 3 causes the control gear 53 to rotate and thereby the V-shaped rib 53*a* lifts up the drive pin 52 vertically to shift the thermal head 5 upward. In the case of rotation of the control gear in the counterclockwise direction, the thermal head is shifted down. A heart-shaped cam may be provided instead of the V-shaped rib 53*a*.

Figure 11:
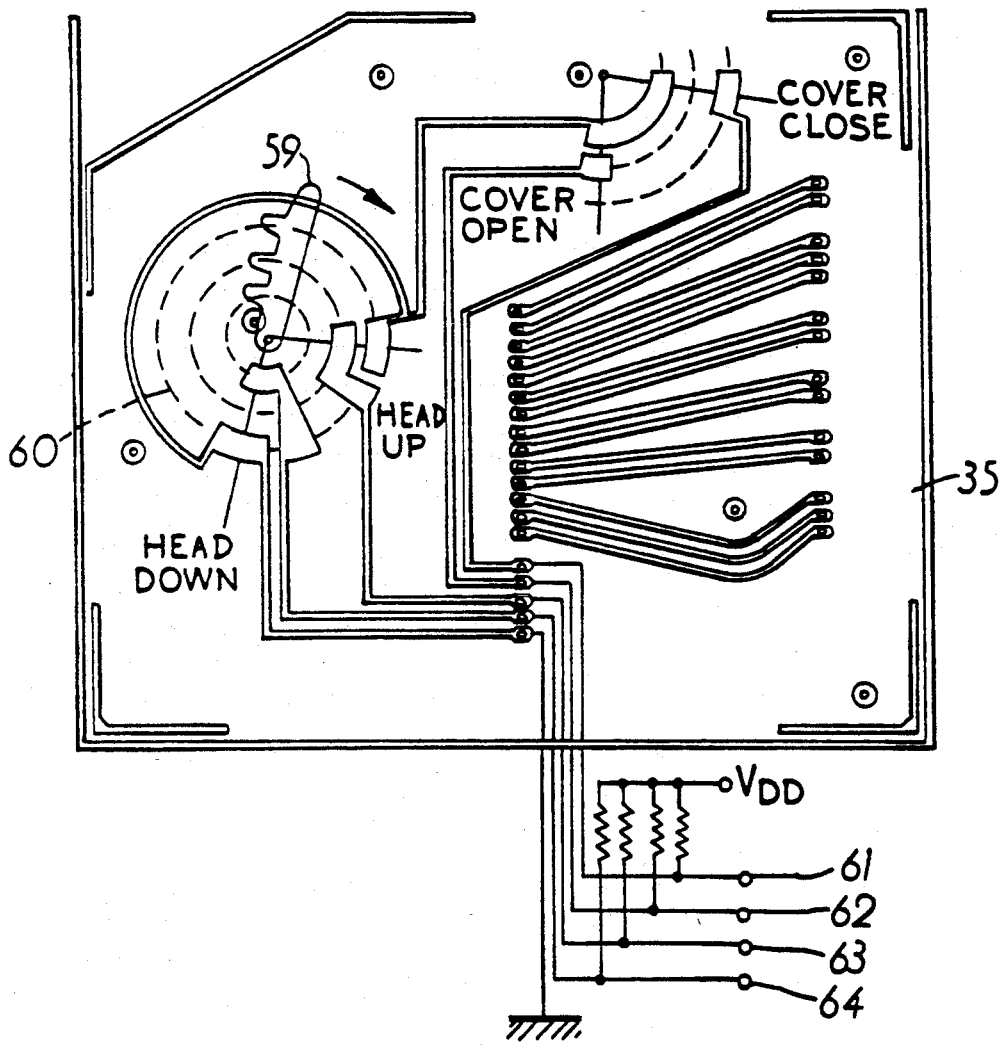
FIG. 11 is a schematic circuit diagram which shows a printed circuit for providing signals indicative of the operations of a thermal head and a front panel.

As shown in FIG. 7, three brushes 59 are installed on a boss of the control gear 53. These brushes rotate to keep in contact with corresponding wires on a printed circuit 60, as shown in FIG. 11, according to the rotation of the control gear to provide signals to a controller (not shown) indicative of the shifting up and down of the thermal head 5. Similarly, another three bushes (not shown) are provided which move on a printed circuit 65 according to the opening and closing operations of the front panel 25 to provide signals indicative of those states to the controller. Note that a printed wire 61 is a terminal for closing the cover 25, a printed wire 62 is a terminal for opening the cover, a printed wire 63 is a terminal for shifting up the thermal head 5, and a printed wire 64 is a terminal for shifting down the thermal head.

Operation

With the front panel closed, depression of a print start button causes the shift motor 57 to be activated so as to rotate the control gear 53. This rotation of the control gear, in turn, causes the thermal head 5 to be shifted down against the platen roller. Simultaneously, the platen roller is rotated by the drive motor 44 to allow an image to be printed on the printing paper while it feeds the printed paper forward.

Figure 10A:
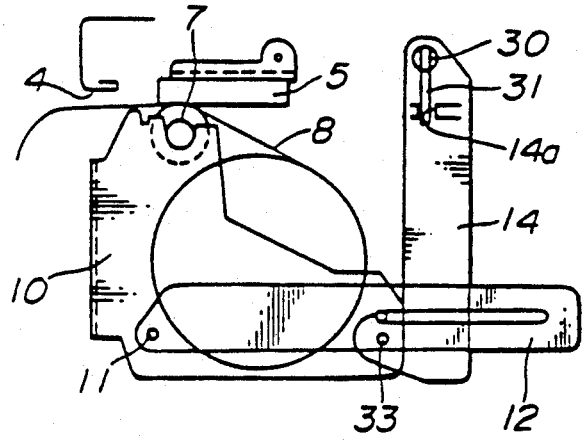
FIGS. 10(*a*), 10(*b*), and 10(*c*) are the right side views which show an unloading operation of a roll of printing paper from a printer.
Figure 10:
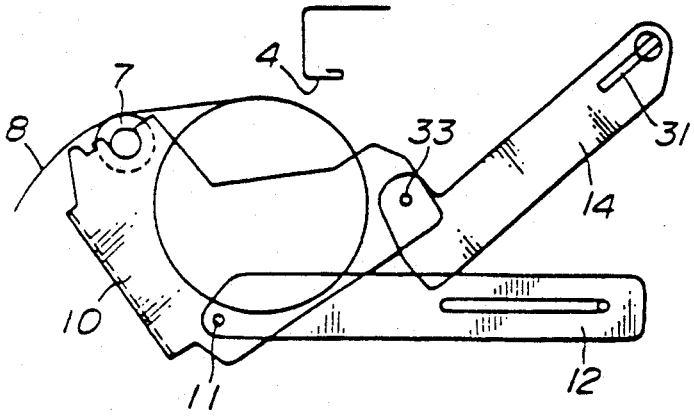
Figure 10C:
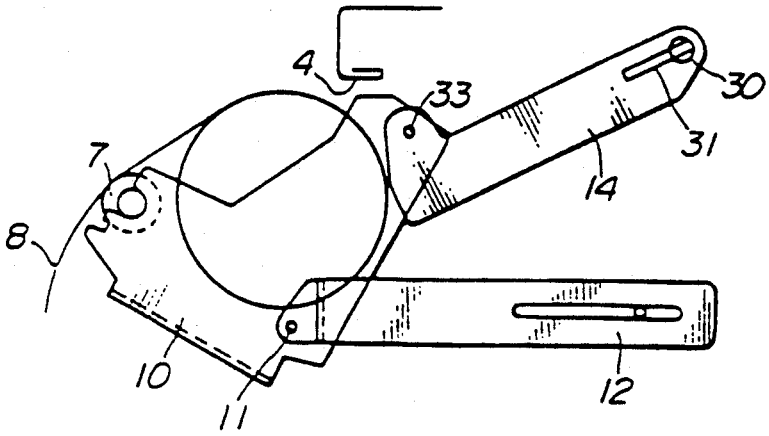

When the roll of paper 8 is loaded into the printer, the head shifter 50 shifts the thermal head 5 up, prior to loading to separate it from the platen roller and the panel motor 38 is actuated to rotate the drive shaft 30. The pair of arm plates 13 and 14, in turn, swing through the pair of drive pins 31 mounted at both ends of the drive shaft 30. According to the swinging motion of the arm plates, as shown in FIG. 10(*b*), the sub-chassis 10 rotates so as to be pushed forward Further rotation of the arm plates, as shown by the broken line in FIG. 4 and FIG. 10(*c*), causes the sub-chassis to rotate with respect to the pair of pins 11. Simultaneously, the guide rails 12 are, as shown by the broken line in FIG. 4, returned slightly. This motion causes the front panel to open so as to expose the paper tray 9 completely for easy loading of a roll of paper 8 into it.

Figure 9A:
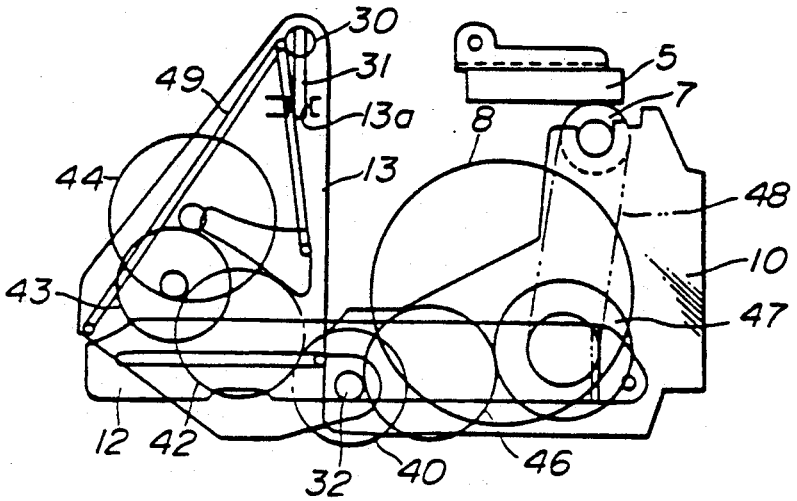
FIGS. 9(*a*) and 9(*b*) are left side views which show an operation for unloading a roll of printing paper from a printer.
Figure 9B:
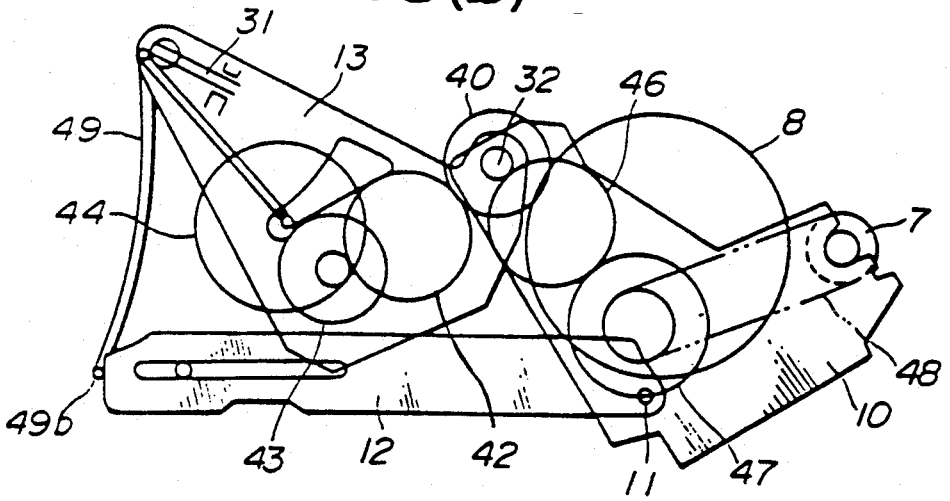

As described above, in the printer according to the invention, the drive motor 44 for the platen roller 7 is, as shown in FIG. 9, mounted on the left arm plate 13 which is disposed rearwardly on the main chassis 6 and thus no gearing for the platen roller 7 is provided on the side of the opening 4. This permits an opening of greatly reduced size. Since the arm plate 13 and the sub-chassis 10 are rotatably supported about the shaft 32 of the intermediate gear 40, the distance between each of the gears 42, 43, 46, and 47 can be kept constant when the sub-chassis moves in opening the front panel. Further, the drive motor 44 and the gears 42 and 43 mounted on the arm plate 13 are removable to facilitate maintenance. The sub-chassis 10 is adapted for moving forward relative to the main chassis 6 with the rotation of the paper tray 9 to expose it from the opening 4 of the printer cabinet 2 and so a roll of paper 8 can be loaded into the paper tray easily. Compared with a conventional printer wherein a paper tray is slidingly displaced only, the traveling distance of the sub-chassis can be shortened to miniaturize the printer body and reduce the thickness thereof.

The pair of arm plates 13 and 14 are supported by the drive shaft 30 with a clearance therebetween. Each of the drive pins 31 mounted in the both end sections of the drive shaft 30 are disposed between the pair of projecting portions so as to allow it to move therebetween to provide play between the drive shaft and the pair of arm plates 13 and 14. Therefore, locating error of the arm plates relative to the drive shaft can be reduced. The magnitude of play between the drive shaft 30 and the pair of arm plates 13 and 14 can be optimally set to achieve relative positioning between the arm plates easily. When the paper tray 8 is retracted into the printer, the platen roller 7 is positioned by the cut away portions 6*c* and 6*d* of the main chassis 6. Therefore, the platen roller can be positioned relative the thermal head easily and precisely.

Figure 6:
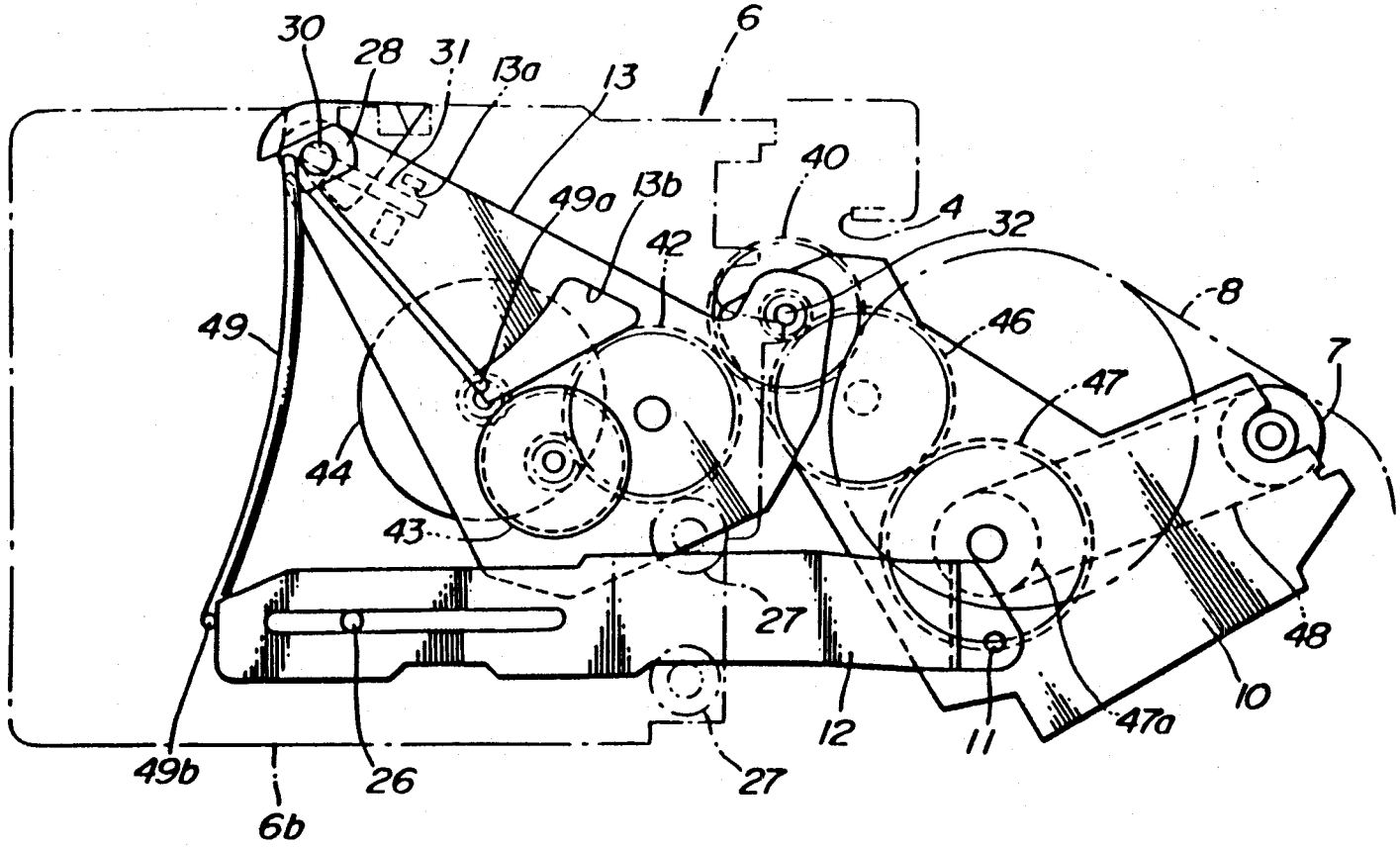
FIG. 6 is a cross-sectional view of the left side of a printer with an open front panel, which shows a front panel sidling mechanism according to the invention.

Further, as shown in FIGS. 6 and 9(*b*), when the front panel 25 is opened, the base portion of the left guide rail 12 is pushed by the end 49*b* of the elastic spring 49, thereby facilitating withdrawal of the sub-chassis 10 into the printer. When the sub-chassis 10 is drawn into the main chassis 6, the base portion of the guide rail 12 is, as shown in FIGS. 4 and 9(*a*), separated from the end 49*b* of the spring 49 completely. Thus, the thermal head 5 is not influenced by the force of the spring 49.

The shifting up and down of the thermal head 5 and the opening and closing of the front panel 25 are carried out automatically by rotating the control gear 53 of the head shifter 50.

Figure 12:
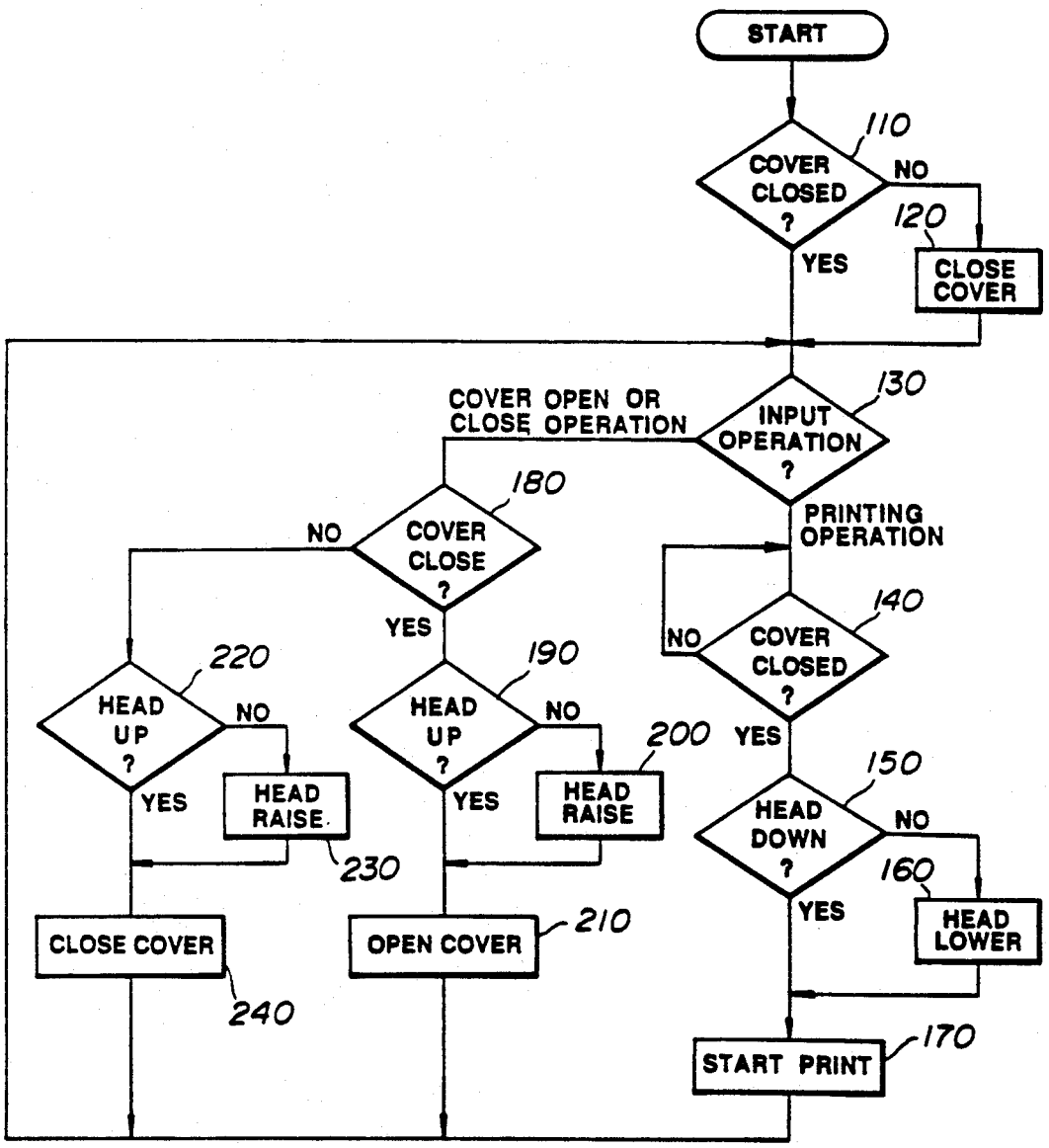
FIG. 12 is a flowchart which shows logical steps performed by a control system of a printer according to the invention.

A program or sequence of logical steps performed by the control system of the printer according to the present invention will now be described with reference to the flowchart of FIG. 12.

After initiation of the program at step 100, the routine proceeds to step 110 at which it is determined whether the front panel 25 is closed or not. If not, the routine proceeds to step 120 in which an input signal indicative of the cover being closed is awaited. If received, the routine proceeds directly to a decision step 130 in which it is determined whether a print start button has been activated or whether an eject button for opening the front panel was activated in order to replace a roll of paper 8. If input indicative of print start is present, the routine proceeds to step 140 in which determination is made again whether the front panel is closed or not. If so, the routine proceeds to step 150 at which it is determined whether the thermal head 5 is shifted down or not. If a NO answer is obtained at step 150, the thermal head 5 is shifted down in step 160. If a YES answer is obtained at step 150, the routine proceeds to step 170 in which the platen roller rotates and the thermal head is energized to start printing on print paper fed from the roll of paper 8 stored in the paper tray. In step 130, if input indicating an open front panel is present, the routine proceeds to a decision step 180 in which determination is made again whether the front panel is closed or not. If a YES answer is obtained in step 180, the routine proceeds to step 190 at which it is determined whether the thermal head is up or not. If a NO answer is obtained in step 190, the thermal head is shifted up in step 200. If a YES answer is obtained in step 190, the routine proceeds directly to step 210 in which the front panel is opened. In step 180, if a NO answer is obtained the routine proceeds to a decision step 220 in which it is determined whether the thermal head is shifted up or not. If a NO answer is obtained in step 220, the thermal head is shifted up in step 230. If a YES answer is obtained in step 220, after a new roll of paper is loaded into the paper tray and the leading edge thereof is inserted between the thermal head and the platen roller, the routine proceeds directly to step 240 in which the front panel is closed.

Although a specific embodiment of the invention has been described in detail herein with reference to the accompanying drawings, it will be understood that the invention is not limited to that specifically disclosed embodiment, and that various changes and modifications may be effected therein by one skilled in the art without departing from the scope or spirit of the invention as defined in the appended claims. For example, in the above embodiment, while the paper tray and the front panel are mounted on the sub-chassis independently, a one piece molding made, for example, of a synthetic resin which includes a paper tray and a front panel may be installed on the sub-chassis.

What is claimed is:

1. A printing apparatus comprising:

a main chassis having a printing head positioned at an upper portion thereof.

a sub chassis having a platen roller rotatably attached thereto and having a printing medium storage means positioned below said platen roller said sub chassis being positioned inside of said main chassis;

sliding means slidably holding said sub chassis for allowing said sub chassis to be drawn in a horizontal direction outward of said main chassis through an aperture therein; and rotating means for opening said printing medium storage means, said, rotating means being drawn by said sliding means via a pivot point provided therefore attaching said sub chassis and said sliding means.

2. An apparatus as set forth in claim 1, wherein said rotating means comprising a pair of arms attached to both sides of said main chassis and said sub chassis.

3. An apparatus as set forth in claim 2 further comprising driving pins each of which is attached to a pivot of each of said arms and is positioned between positioning means formed on each of said arms to allow a clearance between each of said pins and said positioning means.

4. A printer comprising:

a casing;

a first mechanical chassis disposed within said casing, on which a printer head for printing on a printing medium is mounted;

a second mechanical chassis disposed within said first mechanical chasis, on which a platen roller is rotatably mounted;

a housing provided within said second mechanism chassis for storing the printing medium;

first means for linearly shifting said second mechanical chassis relative to said first mechanical chassis; and second means for rotating said second mechanical chassis to expose said housing outside of said casing, said second means being drawn by said first means via a pivot point provided therefor attaching said second mechanical chassis and said first means.

5. A printer as set forth in claim 4, wherein said first means includes a guide plate connected to said second mechanical chassis to allow it to pivot with respect to a connecting point, said guide plate being slidingly held by said first mechanical chassis so as to allow said second mechanical chassis to travel outside said casing.

6. A printer as set forth in claim 5, wherein said second means includes an arm plate having a first end and a second end, said first end being rotatably supported by said first mechanical chassis and the second end being rotatably attached to said second mechanical chassis to allow it to rotate with respect to the connecting point in cooperation with said first means to expose said housing.

7. A printer as set forth in claim 5, wherein said second means includes a pair of arm plates, a shaft, connecting means, and a drive unit for rotating said shaft, said shaft being supported by said first mechanical chassis and supporting one end of each of said arm plates via said connecting means, other ends of said arm plates being rotatably attached to said second mechanical chassis, said connecting means swinging said arm plates synchronously with each other according to rotation of said shaft.

8. A printer as set forth in claim 7, wherein said connecting means includes a pair of pins and pairs of projecting portions which are formed on said arm plates respectively to form an interspace, said pins being inserted into end portions of said shaft and each being located between said projecting portions so as to engage one of said projecting portions upon rotation of said shaft to swing said arm plates synchronously with each other.

9. A printer apparatus comprising:

a cabinet having a front panel, said front panel having a first aperture formed therethrough;

a main chassis having a printing head disposed in an upper portion thereof, said main chassis being disposed inside said cabinet, said main chassis having a second aperture, said second aperture having a contour substantially similar to said first aperture;

a sub chassis having a platen roller rotatably attached thereto, and a printing medium storage means positioned below said platen, said sub chassis being disposed inside said main chassis;

sliding means for supporting said sub chassis and allowing said sub chassis to be substantially horizontally drawn out of said main chassis and said cabinet through said first and second apertures; and rotating means for opening said printing medium storage means, said rotating means being drawn by said sliding means via a pivot point provided therefor attaching said sub chassis and said sliding means, wherein activation of said rotating means occurs during outward movement of said sub chassis via said sliding means, said pivot point moving outward upon outward movement of said sub chassis, and said pivot point receding upon opening of said printing medium storage means.

* * * * *